US007434353B2

(12) United States Patent
Nien et al.

(10) Patent No.: US 7,434,353 B2
(45) Date of Patent: Oct. 14, 2008

(54) ELECTRIC BLIND

(75) Inventors: Ming Nien, Taichung (TW); Keng Hao Nien, Taichung (TW); Homg Tsann Huang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 11/327,451

(22) Filed: Jan. 9, 2006

(65) Prior Publication Data

US 2007/0157519 A1 Jul. 12, 2007

(51) Int. Cl.
*E06B 7/096* (2006.01)

(52) U.S. Cl. ..... 49/82.1; 49/74.1; 49/403

(58) Field of Classification Search ..... 49/82.1, 49/80.1, 74.1, 90.1, 87.1, 403, 73.1; 52/473; 454/277, 278, 280, 281, 309
See application file for complete search history.

(56) References Cited

U.S. PATENT DOCUMENTS

| | | | | |
|---|---|---|---|---|
| 5,379,551 | A * | 1/1995 | Swapp | 49/82.1 |
| 6,145,251 | A * | 11/2000 | Ricci | 49/82.1 |
| 6,568,131 | B1 * | 5/2003 | Milano, Jr. | 49/82.1 |
| 6,675,534 | B2 * | 1/2004 | Marocco | 49/86.1 |
| 6,854,211 | B1 * | 2/2005 | Blachley | 49/82.1 |
| 7,178,291 | B2 * | 2/2007 | Vasquez | 49/82.1 |

* cited by examiner

*Primary Examiner*—Jerry Redman
(74) *Attorney, Agent, or Firm*—MIng Chow; Sinorica, LLC

(57) ABSTRACT

An electric blind includes a frame, a plurality of horizontal slat units, and a stepping motor. The frame has two side vertical rods pivotally connected with the slat units, and a linking rod is fixed with a lengthwise side of all the slat units, possible to force the slat units synchronously swing for an angle. The stepping motor unit is composed of a stepping motor and a controller. The stepping motor is positioned in a cavity of one of the two side vertical rods, connected with a slat of the salt units. Further the controller controls the rotating angle of the motor, and the stepping motor can rotate idle in case the motor should meet an exterior force (for example, in case of the slat units already swung to the largest angle), or the slat units are manually moved any time. Thus the electric blind may not easily be broken or damaged.

13 Claims, 6 Drawing Sheets

ELECTRIC BLIND

BACKGROUND OF THE INVENTION

1. Field of the Invention

This invention relates to an electric blind, particularly to one provided with a stepping motor for driving the slat units of a blind to let the slat units swing for a needed angle.

2. Description of the Prior Art

A conventional blind shown in FIG. 1 includes a frame 1 and a plurality of horizontal slats 2 pivotally arranged in the frame 1, and all the horizontal slats 2 are connected with a linking rod 3 so that all the slats 2 may swing all synchronously, driven by a motor 4 installed in an interior of the frame 1.

However, the slats of the conventional blind cannot be adjusted in their angle to be swung, in spite that the slats can be swung by the motor, only having two angles, that is, one for opened and another for closed. Moreover, in case that the slats receive an exterior force and stopped immovable, the coil of the motor 4 may be overloaded to burn up.

SUMMARY OF THE INVENTION

The electric blind in the invention includes a frame, a plurality of slat units, a linking rod, and a stepping motor unit. The frame has two side vertical rods pivotally connected with the horizontal slat units between, and the linking rod is fixed with a lengthwise side of all the slat units, so all the slat units may synchronously swing to an angle by the function of the linking rod when the steeping motor rotates one of the slat units, The stepping motor is positioned in one of the two side vertical rods, connected with only one end of one slat unit so that all the slat units may swing at the same time by function of the linking rod.

In addition, the stepping motor is moved by input pulse to generate a certain angle rotation and its angle rotated is accurate owing to the input pulse controlling its extent of rotation, and at the same time the motor can rotate idle in case of the input pulse interrupted by an exterior force. Therefore, the slat units cannot be driven temporarily by the stepping motor if the stepping motor receives irregular resistance (such as when the slat units swings to the utmost angle), or if the slat units are pulled by a user any time, avoiding damage.

BRIEF DESCRIPTION OF DRAWINGS

This invention will be better understood by referring to the accompany drawings, wherein.

DETAILED DESCRIPTION OF THE PREFERRED EMBODIMENT

Figure 1:
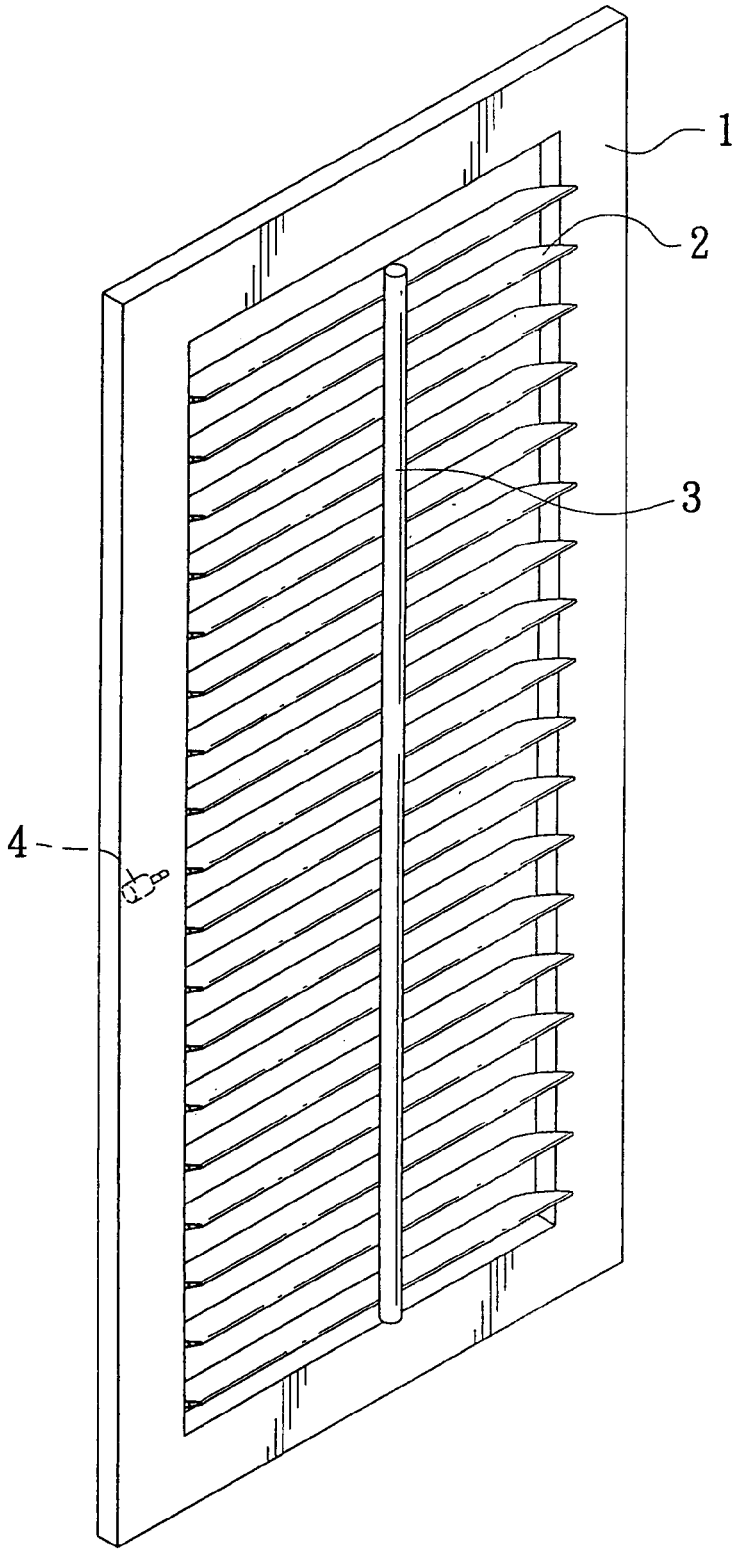
FIG. 1 PRIOR ART
FIG. 1 is a perspective view of a conventional electric blind.
Figure 2:
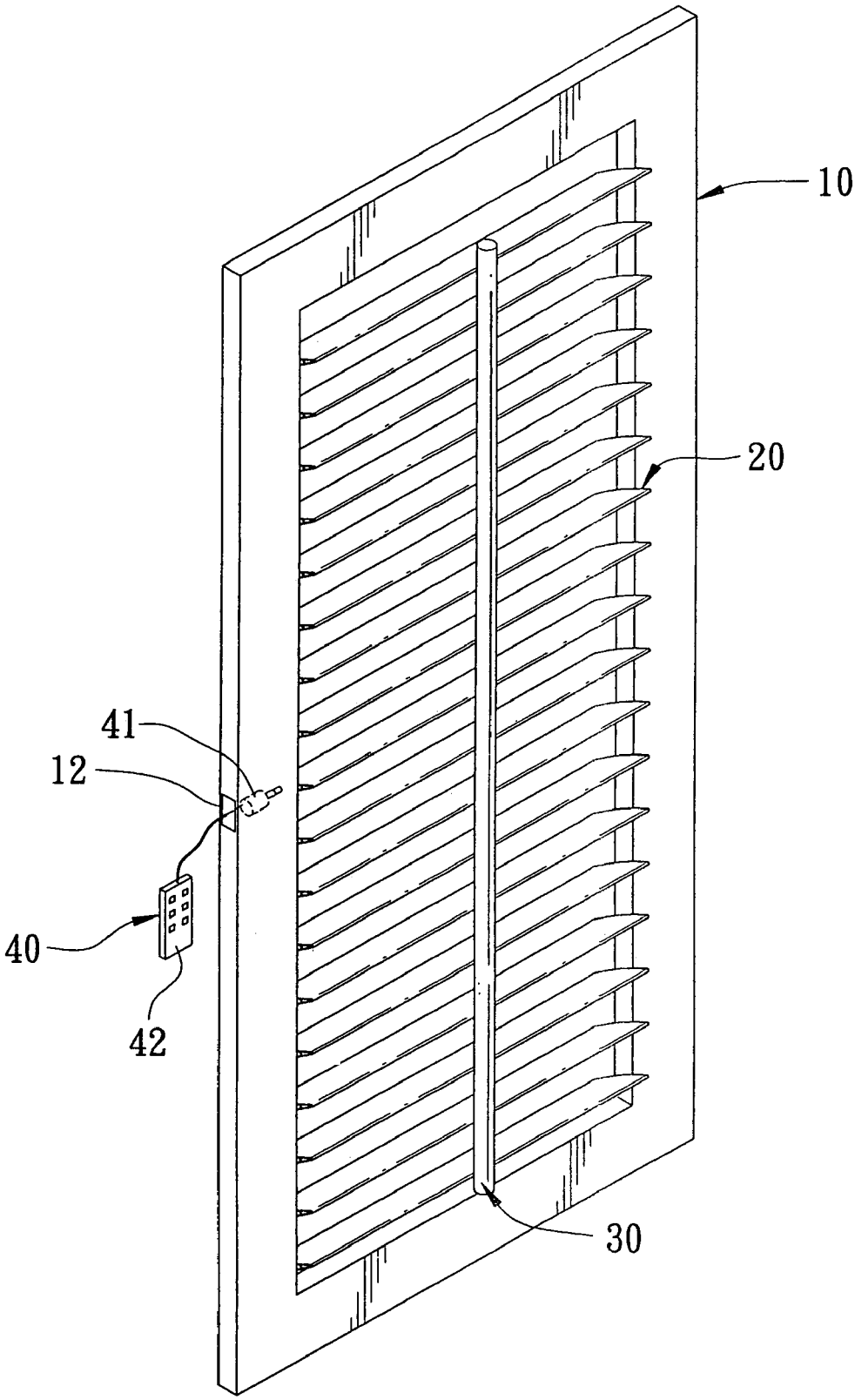
FIG. 2 is a perspective view of a preferred embodiment of an electric blind in the present invention.
Figure 3:
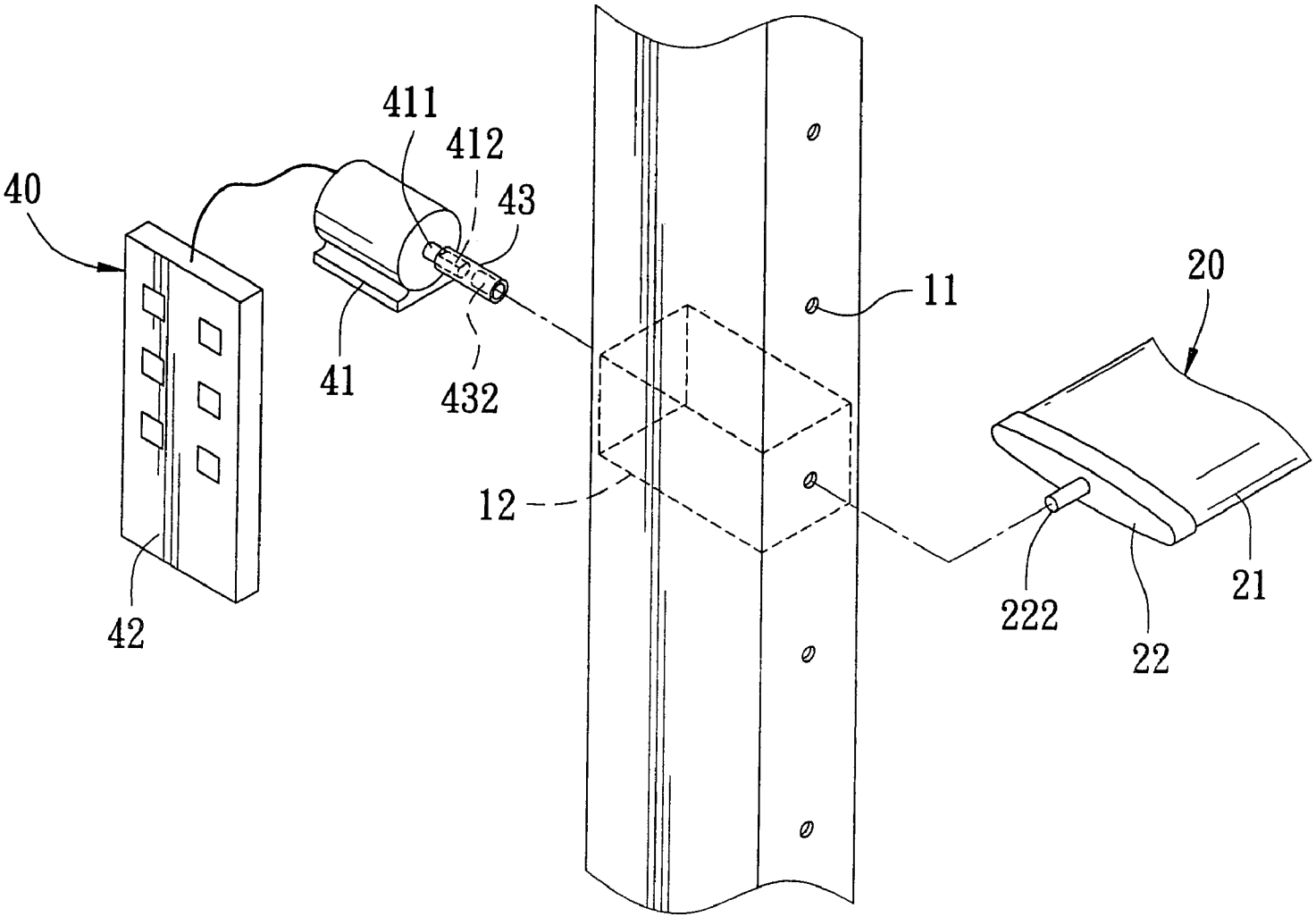
FIG. 3 is a partial exploded perspective view of the preferred embodiment of an electric blind in the present invention.

A preferred embodiment of an electric blind in the present invention, as shown in FIGS. 2 and 3, includes a frame 10, a plurality of slat units 20, a linking rod 30 and a stepping motor unit 40 as main components, The frame 10 is provided with a plurality of insert holes 11 spaced apart equidistantly in two side vertical rods respectively, and a cavity 12 just behind one of the insert groove 11 in one of the two vertical rods. The insert holes 11 in one side vertical rod are respectively at the same level with those 11 in the other side vertical rod to align to each other.

Figure 4:
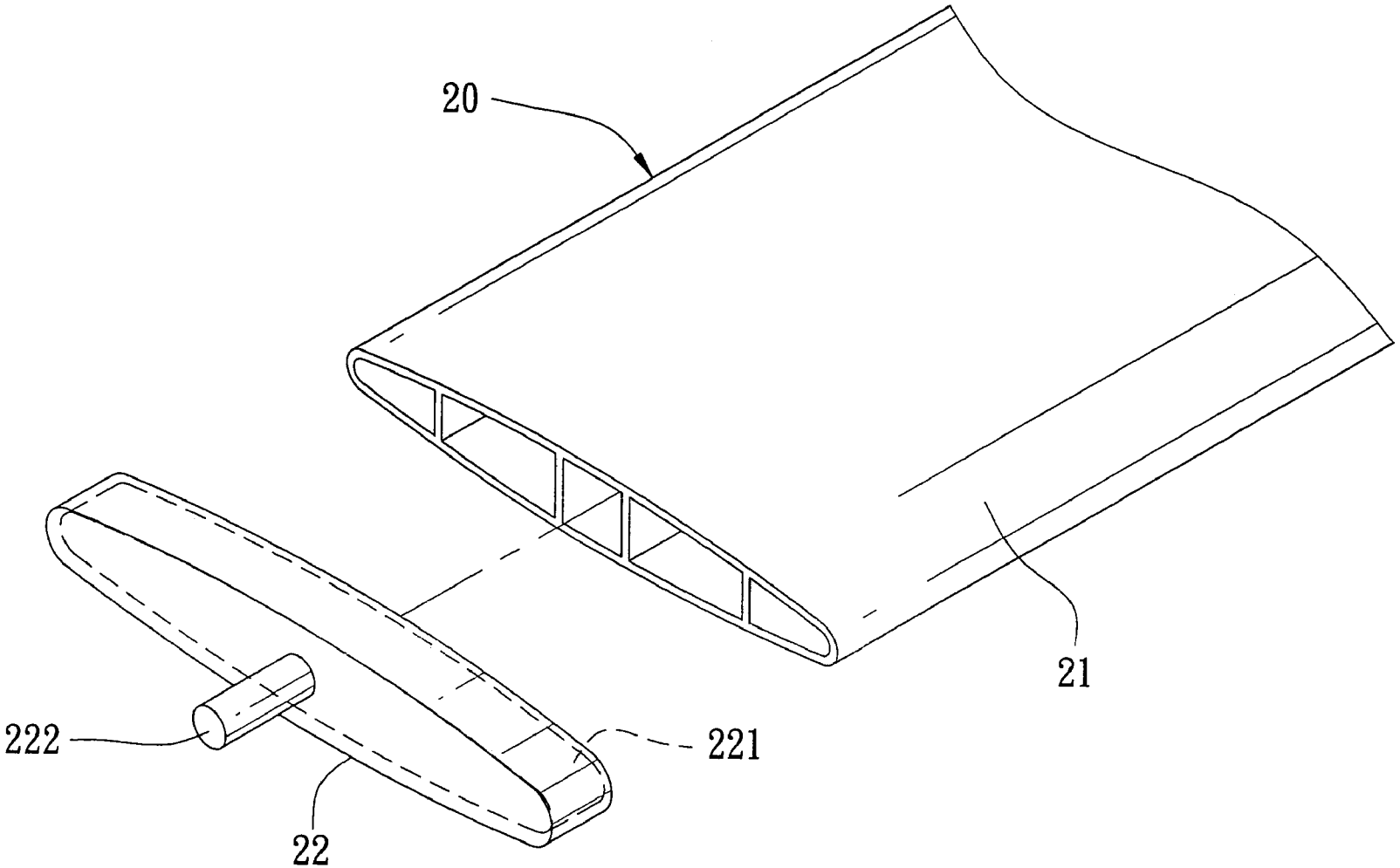
FIG. 4 is an exploded perspective view of a slat unit in the present invention.

Each slat unit 20 as shown in FIG. 4, consists of a slat 21 and two end caps 22 with a recessed hollow 221 to fit around one of the two ends of the slat 21. Further, a pin 222 is fixed with in a center of an outer side of the end cap 22 to fit in the insert hole 11 of the side vertical rod of the frame so that each slat 21 may be combined pivotally and horizontally with the frame.

The connect rod 30 is fixed vertically with an lengthwise side of all the horizontal slats 21 so that all the slat units 20 may rotated for a certain angle at the same time by the interactive function of the connect rod 30, when they are driven by the stepping motor unit 40.

Figure 5:
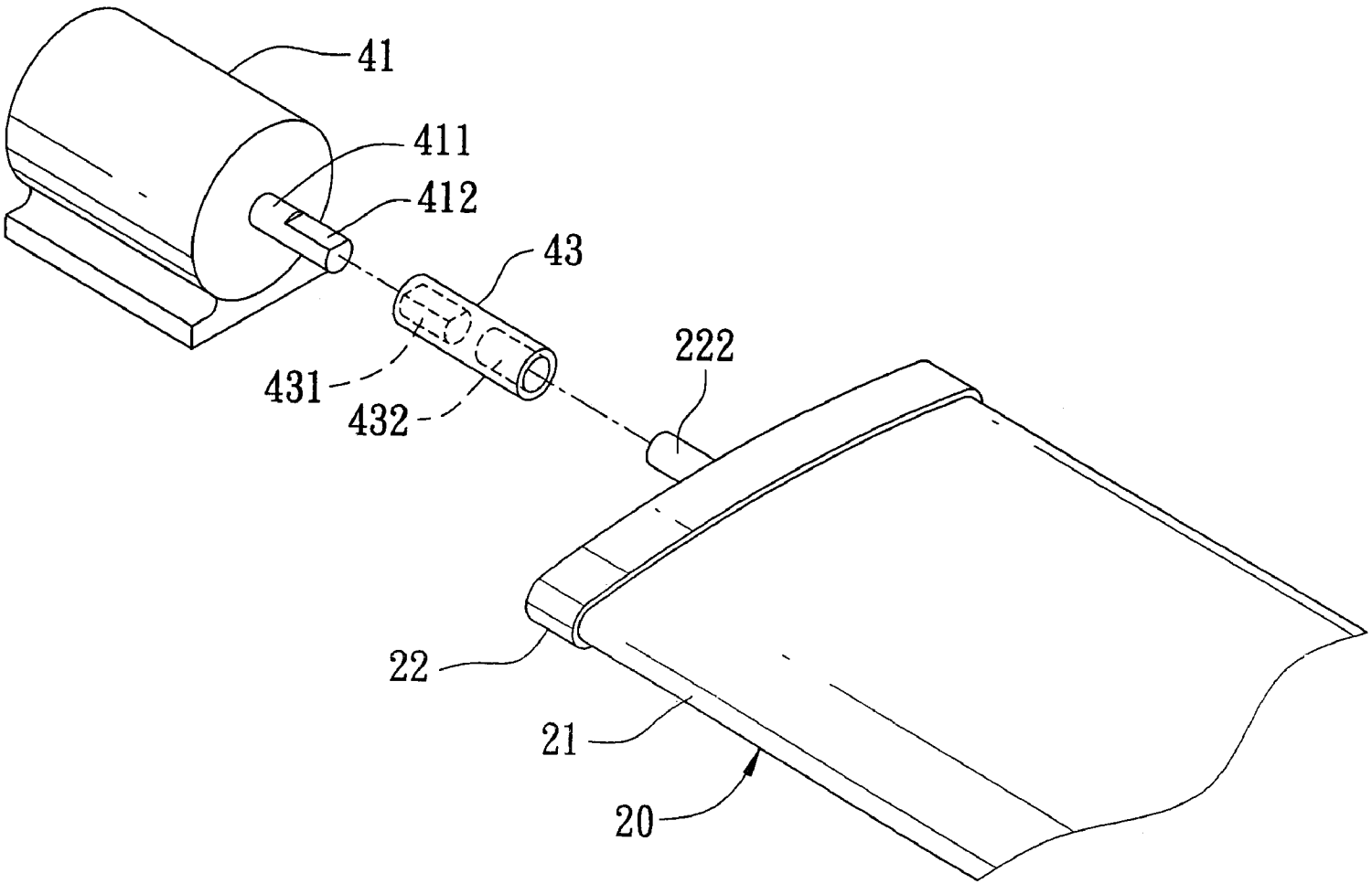
FIG. 5 is a perspective view of a stepping motor to be combined with one slat unit in the present invention; and, FIG. 6 is a side view of a second embodiment of an electric blind with a stepping motor and a slat angle sensor in the present invention.

The stepping motor unit 40 consists of a stepping motor 41 and a controller 42, and the stepping motor 41 is positioned in the cavity 12 of the frame 10 and has a shaft 411, which is provided with a flat position surface 412 on its end. Further a linking member 43 fits around the flat position surface 412 of the shaft 411, having a position groove 431 and a fit groove 432 respectively in two ends. Then the shaft 411 of the stepping motor 41 fits in the position groove 431 of the linking member 43, and one of the slat unit 20 fits in the fit groove 432 of the linking member 43 so that the stepping motor unit 40 may drive all the slats units 20 through the connect rod 20 for changing the angle of the slat units 20. As to the controller 42, it is connected with the rear side of the motor 41, controlling the input pulse of the stepping motor 41 by means of infrared ray, Next, how to use the electric blind in the invention is to be described as follows. Referring to FIGS. 3, 4 and 5, the electric blind has the slat units 20 possible to be handled to manually change the angle of the slat units 20, and also at the same time possible to be electrically handled to change the angle of the slat units 20. In case of electrically changing the angle of the slat units 20 of this blind, the controller can control the input pulse to the stepping motor 41 so the shaft 411 of the stepping motor 41 may be rotated to a needed angle. Thus the electric blind is changed in its angle by the controller 42, which controls the input pulse to the stepping motor 41 and adjusts the rotating angle of the motor 41 so as to make the slat units 20 rotate for a needed angle. Provided that the slat units 20 should be interrupted by an external force and become stopped, the input pulse to the motor 41 might not force the stepping motor 41 overloaded, enabling the slat units 20 still be swung for a needed angle whether the stepping motor 41 rotates or not, because the stepping motor 41 can rotate idle in the worst case.

In addition, it is worth mentioning that the slat units 20 can have a movement to return to a zero point so the controller or manual operation can swing the slat units 20 to the zero point. In other words, the stepping motor 41 can rotate idle if the slat units 20 is swung to the utmost point, and if the stepping motor 41 keeps on rotating for a preset time, the slat units 20 can be shut completely (i.e., move to the zero point). And subsequently if the motor starts from the zero point, the slat units 20 are to be swung precisely to the needed angle according to the input pulse.

Figure 6:
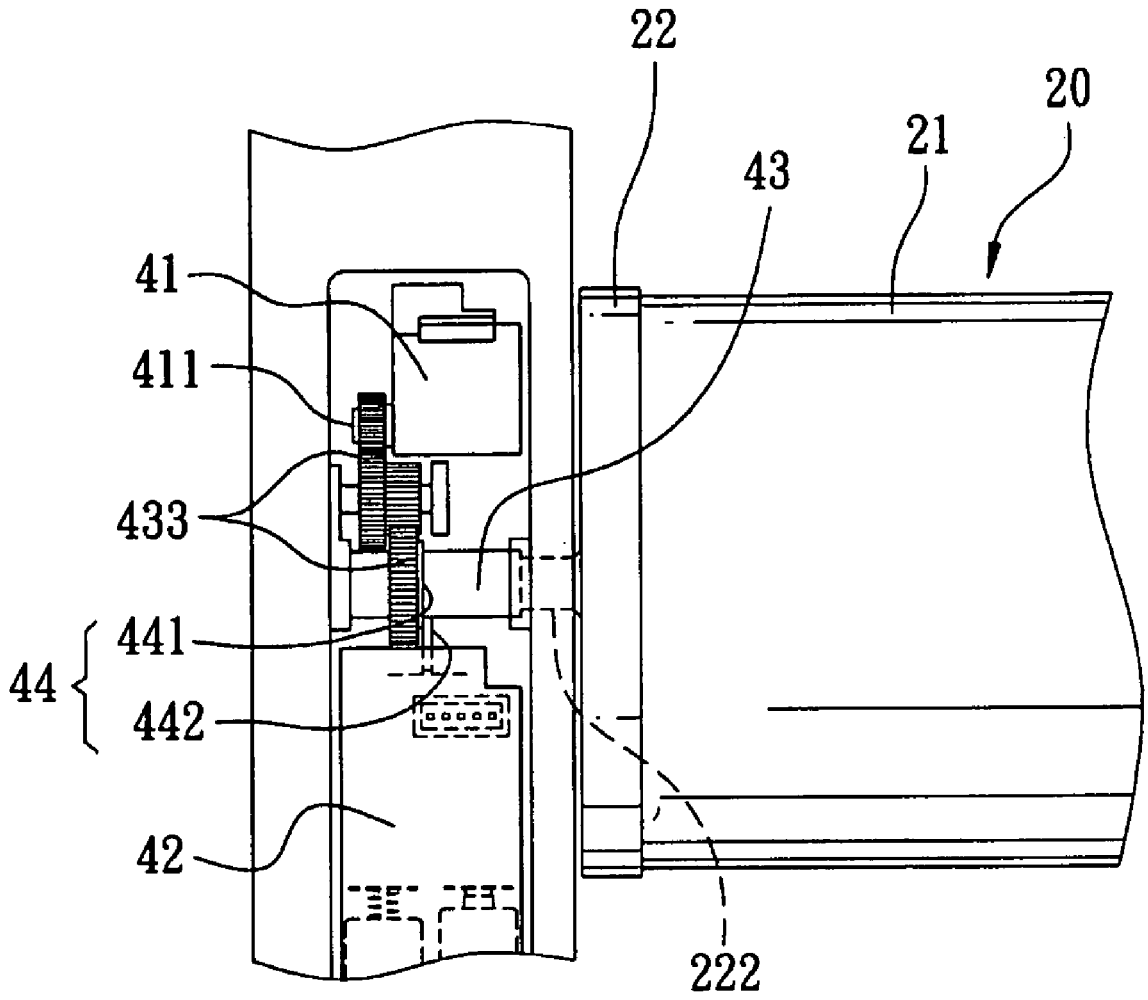

Next, FIG. 6 shows a second preferred embodiment of an electric blind in the invention, which has the same structure as the first one, except that a gear unit is added between the motor 41 and the linking member 43. The gear unit consists of a gear unit 433 and a set switch 44. The gear unit 433 can be a bevel gear unit. The set switch 44 is composed of a protruding wheel 441 and an electrical switch 442, and the protruding wheel can fit around the linking member 43 or firmly connected with the slat 21, the end cap 22 or the pin 222. Then when the slat 21 reaches the zero point, it touches the electrical switch 442, which then generates a signal, and the controller 42 receives the signal of the zero point from the slat unit 20. Besides, the number of the combination of the protruding wheel 441 and the electrical switch 442 can be increased, augmenting the number of sensing points. For example, more accurate and timely control can be got by eight different locations that three sensing points in conjunction with a two digit code mode can obtain. It goes without saying that the sensing signal can be substituted by a photo-sensing mode, which is a well-known art not to be described here.

Lastly, the invention has the following advantages, as can be seen from the foresaid description.

The slat units can be manually rotated even if the stepping motor is still in operation, and then the stepping motor can rotates idle. Therefore, the angle of the slat units can be adjusted, not making any damage to the stepping motor, with its service life prolonged.

The control signal for the motor is pulse, so the rotating process for an angle of the slat units is in proportion to the number of the pulse. It means that the angle of the slat units can be accurately calculated by the number of the input pulse, so the stepping motor can make a preset angle rotation owing to the function of the controller, with its practicality and accuracy of the control increased.

While the preferred embodiments of the invention have been described above, it will be recognized and understood that various modifications may be made therein and the appended claims are intended to cover all such modifications that may fall within the spirit and scope of the invention.

What is claimed is:

1. An electric blind comprising:

a frame having plural insert holes respectively in two side vertical rods, said plural insert holes spaced apart equidistantly, and a cavity formed in one of said side vertical rods just behind one of said plural insert holes;

a preset number of slat units, each slat unit having a pin extending forward from two ends and fitting in one of said insert holes of said frame;

a linking rod fixed vertical with one lengthwise side of all said horizontal slat units, said linking rod moves up and down together with all said slat units when said slat unit is swung by a stepping motor for an angle;

a stepping motor unit composed of said stepping motor and a controller, said stepping motor positioned in said cavity of said frame, said stepping motor connected with said slat having said pin inserted in said cavity and said slat unit is swung by stepping said motor, said controller controlling input signal fed in said stepping motor, wherein said motor is connected with said slat unit by means of a linking member, which has two opposite sides respectively provided with a position groove and an insert groove lengthwise, said motor has a shaft provided with a flat position surface to fit in said position groove of said linking member, and said pin fits in said insert groove; and a set switch is fixed between said motor and said slat unit and having a protruding wheel and an electrical switch, a location signal corresponding with a pivotal movement of said slat unit is generated by said electrical switch, said electrical switch sends said location signal to said controller and said controller resets the location of said slat units.

2. The electric blind as claimed in claim 1, wherein at least one of said slat units has a slat with at least one end fitted with an end cap, said slat has a preset shape, said end cap is provided with a recessed groove to fit with said end of said slat, and said end cap has the pin extending outward.

3. The electric blind as claimed in claim 1, wherein said controller is directly connected with said motor.

4. The electric blind as claimed in claim 1, wherein said controller controls said motor by infrared ray.

5. The electric blind as claimed in claim 1, wherein said controller controls operation of said motor by pulse, and at the same time, the rotating angle of said motor makes up a constant proportion with the number of input pulse of said controller.

6. The electric blind as claimed in claim 1, wherein a gear unit is pivotally provided between said motor and said slat unit connected with said motor, said motor connected with an input end of said gear unit, and said pin of said slat unit is connected with an output of said gear unit.

7. An electric blind comprising:

a frame having plural insert holes respectively in two side vertical rods, said plural insert holes spaced apart equidistantly, and a cavity formed in one of said side vertical rods just behind one of said plural insert holes;

a preset number of slat units, each slat unit having a pin extending forward from two ends and fitting in one of said insert holes of said frame;

a linking rod fixed vertical with one lengthwise side of all said horizontal slat units, said linking rod moves up and down together with all said slat units when said slat unit is swung by a stepping motor for an angle;

a stepping motor unit composed of said stepping motor and a controller, said stepping motor positioned in said cavity of said frame, said stepping motor connected with said slat having said pin inserted in said cavity and said slat unit is swung by stepping said motor, said controller controlling input signal fed in said stepping motor;

a plurality of end caps, each end cap of the plurality of end caps has the pin extending outwardly from a first side thereof and a recessed groove located on a second side thereof opposite the pin, the recessed groove being spaced apart from an exterior periphery of the end cap and having a shape corresponding to a peripheral cross section of each slat unit, an end of one slat unit is inserted into each recessed groove of each end cap of the plurality of end caps; and a set switch is fixed between said motor and said slat unit and having a protruding wheel and an electrical switch, a location signal corresponding with a pivotal movement of said slat unit is generated by said electrical switch, said electrical switch sends said location signal to said controller and said controller resets the location of said slat units.

8. The electric blind as claimed in claim 7, wherein one pin is integrally made with each end cap.

9. The electric blind as claimed in claim 7, wherein said controller is directly connected with said motor.

10. The electric blind as claimed in claim 7, wherein said controller controls said motor by infrared ray.

11. The electric blind as claimed in claim 7, wherein said controller controls operation of said motor by pulse, and at the same time, the rotating angle of said motor makes up a constant proportion with the number of input pulse of said controller.

12. The electric blind as claimed in claim 7, wherein said motor is connected with said slat unit by means of a linking member, which has two opposite sides respectively provided with a position groove and an insert groove lengthwise, said motor has a shaft provided with a flat position surface to fit in said position groove of said linking member, and said pin fits in said insert groove.

13. The electric blind as claimed in claim 7, wherein a gear unit is pivotally provided between said motor and said slat unit connected with said motor, said motor connected with an input end of said gear unit, and said pin of said slat unit is connected with an output of said gear unit.

* * * * *